United States Patent [19]

Ogihara et al.

[11] 4,270,195

[45] May 26, 1981

[54] ALARM SETTING INDICATION DEVICE FOR DIGITAL CLOCK

[75] Inventors: Masuo Ogihara; Kozo Chimura; Nobuo Shinozaki; Yoichi Seki, all of Shikawatashi, Japan

[73] Assignee: Seiko Koki Kabushiki Kasiha, Tokyo, Japan

[21] Appl. No.: 112,183

[22] Filed: Jan. 15, 1980

[30] Foreign Application Priority Data

Feb. 27, 1979 [JP] Japan ..... 54-22337

[51] Int. Cl.[3] ..... G04B 23/02; G04B 19/20

[52] U.S. Cl. ..... 368/74; 368/78; 368/249

[58] Field of Search ..... 368/72, 74, 78, 222, 368/235, 243, 249, 250, 262

[56] References Cited

U.S. PATENT DOCUMENTS

| | | | |
|---|---|---|---|
| 3,922,843 | 12/1975 | Kobayashi | 368/74 |
| 4,005,570 | 2/1977 | Miyamoro et al. | 368/235 |
| 4,122,659 | 10/1978 | Hashimoto | 368/78 |

*Primary Examiner*—Vit W. Miska

*Attorney, Agent, or Firm*—Robert E. Burns; Emmanuel J. Lobato; Bruce L. Adams

[57] ABSTRACT

An alarm time is digitally indicated by the figures on a first drum indicating the hour unit and a second drum indicating the minute unit of the alarm time. An alarm setting indication plate comprises a shutter for covering the figures and an arm interlocked with an alarm stopping button through the first and second drums.

10 Claims, 6 Drawing Figures

ALARM SETTING INDICATION DEVICE FOR DIGITAL CLOCK

BACKGROUND OF THE INVENTION

This invention relates to an alarm setting indication device for the digital clock.

It is known to confirm the state of alarm setting of a drum type or leaf type digital clock having an alarm device by watching the position of the alarm stopping button. With this method of confirmation, however, the alarm time is apt to be set inadvertently without resetting the alarm stopping button so that the alarm fails to go off at the due time.

SUMMARY OF THE INVENTION

Accordingly an object of the present invention is to eliminate the described disadvantage.

Another object of the present invention is to provide an alarm setting indication device of a simple construction and which facilitates easy recognition of alarm time, for a digital clock provided with an hour unit alarm time indication drum and a minute unit alarm time indication drum for indicating alarm time.

According to the invention, the object of the invention is attained by interlocking one end of an alarm setting indication plate, provided between a first drum for indicating the hour unit of alarm time and a second drum for indicating the minute unit of the same, with an alarm stop operating member. The other end of the alarm setting indication plate is provided with a shutter for covering a part of the first and second drums.

BRIEF DESCRIPTION OF DRAWINGS

The accompanying drawings illustrate a preferred embodiment according to the present invention wherein.

DESCRIPTION OF THE PREFERRED EMBODIMENT

Figure 1:
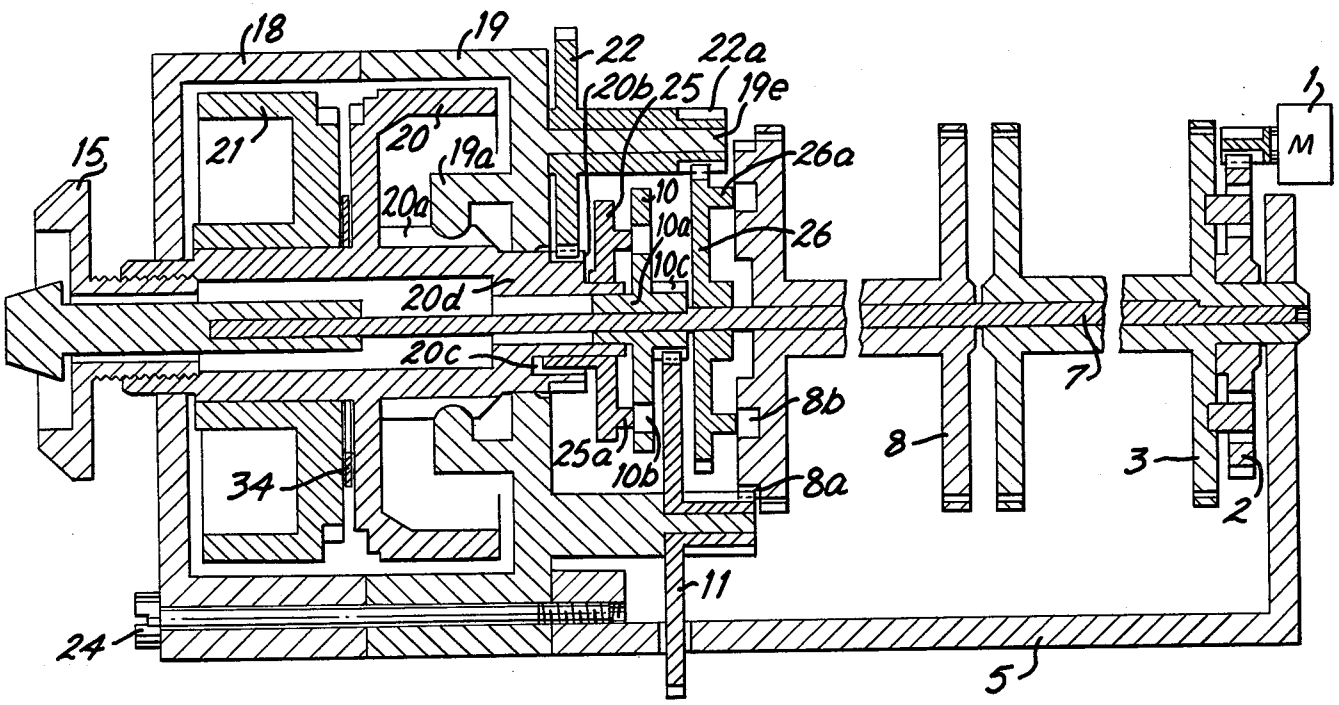
FIG. 1 is a sectional view of the principal part of the alarm device of this invention.
Figure 2:
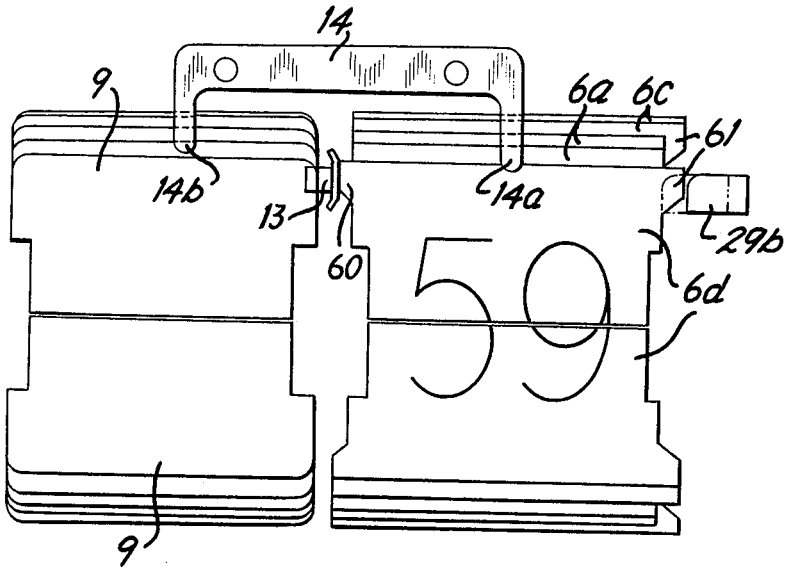
FIG. 2 is a partial diagrammatic view illustrating the leaf blocks.

Referring to the attached drawings, a time indicating mechanism will first be described. A driving motor (1) drives a minute wheel (2) at a rate of one turn per 60 minutes. The minute wheel (2) drives a minute drum (3) in one direction through a known click and ratchet wheel mechanism.

The minute drum (3) has 60 sheets of minute leaves and is fixed to a shaft (7), the right end of which is rotatably supported on a case (5). One set of minute leaves is constituted of first minute leaves (6*a*) having no projection, second minute leaves (6*b*) having a protrusion (60), not shown, on their left end, third minute leaves (6*c*) having a protrusion (61) on their right end and fourth minute leaves (6*d*) having the left protrusion (60) and the right protrusion (61) on their left end and right end, respectively. In indicating the minute unit from 00 minute to 44 minute, the upper leaves are arranged as, two successive first leaves (6*a*) for 00 minute and 01 minute, three successive third leaves (6*c*) for 02, 03 and 04 minute, then again two successive first leaves (6*a*) for 05 and 06 minute. Thus repetition of the combination of two successive first leaves (6*a*) and three successive third leaves (6*c*) indicate from 00 minute to 44 minute. In the similar manner, two successive second leaves (6*b*) are used for 45 and 46 minute, three successive fourth leaves (6*d*) are used for 47, 48 and 49 minute, thus repetition of the combination of two successive second leaves (6*b*) and three successive fourth leaves (6*d*) indicate from 45 minute to 59 minute.

An hour drum (8) having 48 sheets of hour leaves (9) is rotatably mounted on the shaft (7).

A second minute wheel (10) is fixed at the middle of the shaft (7). The boss (10*a*) of the second minute wheel (10) is rotatably supported by the boss of a minute unit alarm time indicating drum (20).

The second minute wheel (10) has cam holes (10*b*) and a pinion (10*c*) engaged with an hour wheel (8*a*) provided for the hour drum (8) through an intermediate hour wheel (11). Cam holes (8*b*) are provided on the left face of the hour wheel (8*a*).

While an hour leaf holding spring (13) is lifted by the left projection (60) of the second minute leaves or the fourth minute leaves, the hour leaf holding spring (13) holds the hour leaf (9) so as not to turn over in the event the hour leaf (9) escapes from a second finger (14*b*) of a releasing spring (14). When the fourth minute leaf (6*d*) indicating 59 minute escapes from a first finger (14*a*) of the releasing spring (14) and 00 minutes is shown, the restraint of the hour leaf by the hour leaf holding spring (13) is cancelled so that an hour leaf (9) is allowed to turn over.

The alarm mechanism will now be described.

The minute unit alarm time indicating drum (20) is marked with figures (00, 05, . . . ) indicating the minute unit of alarm time at intervals of five minutes. The minute unit alarm time indicating drum (20) is rotatably supported at one end by a middle plate (19) fixed to the case (5) by screws (24) and at the other end by a side plate (18) fixed to the middle plate (19).

Figure 5:
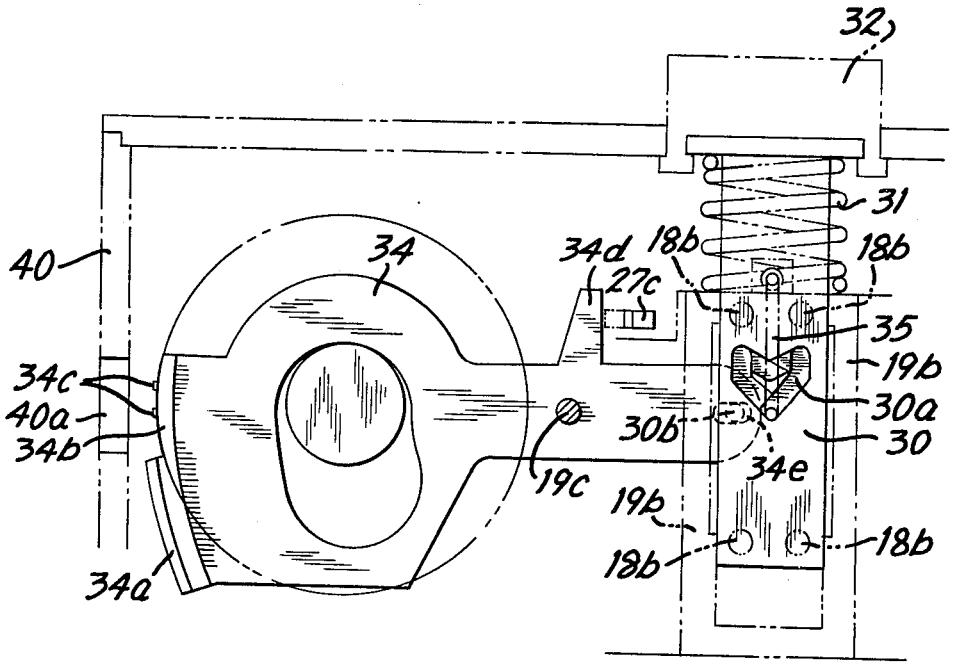
FIG. 5 illustrates the alarm resetting mechanism in the alarm reset position.

A hour unit alarm time indicating drum (21), the marks of which are advanced at intervals of one hour through a carrying-up wheel, not shown, at every turn of the minute unit alarm time indicating drum (20), is rotatably supported by the boss of the minute unit alarm time indicating drum (20). The hour unit alarm time indicating marks (AM 10, AM 11, . . . ) are marked on the periphery of the hour unit alarm time indicating drum (21). These alarm time indicating marks provided on the periphery of the drums (20) and (21) are observed in an alarm time indicating window (40*a*) provided on the front face (40) of the clock as shown in FIG. 5. An alarm stopping shaft (30) is guided by a guide wall (19*b*) projecting from the middle plate and pins (18*b*) projecting from the side plate so as to be able to be moved in the axial direction and always urged upwards by a spring (31). A heart cam (30*a*) is formed at the middle of the alarm stopping shaft (30) and a pin (30*b*) is fixed on the other side. An alarm stopping button (32) is fixed to the alarm stopping shaft (30). An alarm setting indicating plate (34) is disposed between the drums (20) and (21) and rotatably supported by a boss (19*c*) of the middle plate (19). A slot (34*e*) provided on one end of the alarm setting indicating plate (34) is engaged with the pin (30*b*) fixed to the alarm stopping shaft (30) and on the other end, a first shutter (34*a*) for covering the alarm time indicating marks provided on the drums (20) and (21) and a second shutter (34*b*) for filling the gap between the drums (20) and (21) are formed. Dots (34*c*) are provided on the second shutter (34*b*). An operating arm (34*d*) is formed at the middle of the second shutter (34*b*). The heart cam (30*a*) formed on the alarm stopping shaft (30) is related with a pin lever (35) rotatably supported by the middle plate (19) to constitute a known push-and-push mechanism.

Figure 6:
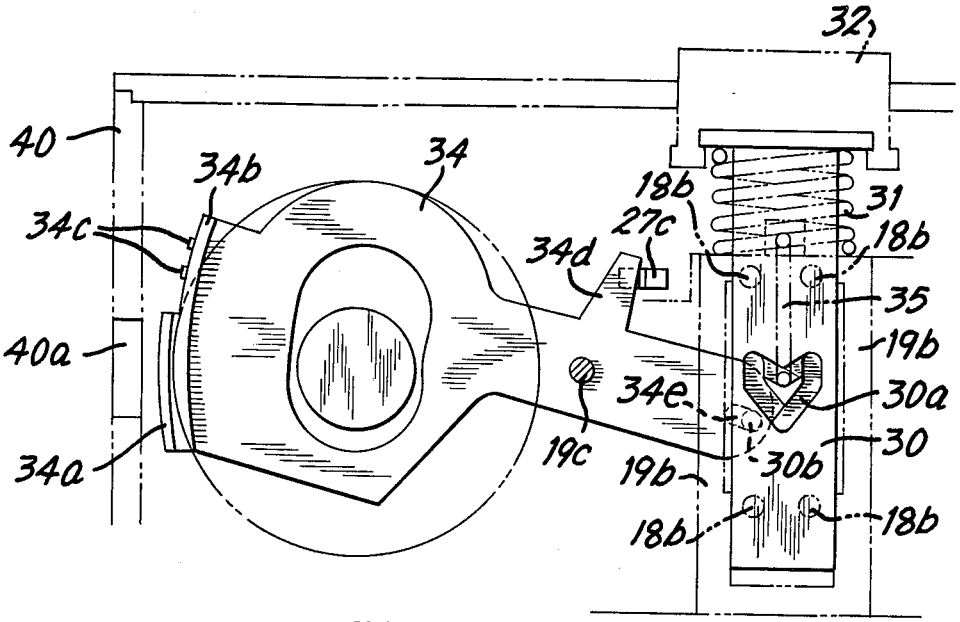
FIG. 6 illustrates the alarm resetting mechanism in the alarm stop position.

With the alarm mechanism set, the alarm stopping button (32) is restrained at the upper position (FIG. 5), and with the alarm mechanism stopped, the alarm stopping button (32) is restrained at the lower position (FIG. 6). Teeth (20*a*) provided on the minute unit alarm time indicating drum (20) engage with a stop spring (19*a*) projecting from the middle plate (19) so that the rotation of the drum (20) is checked at intervals of five minutes. On the right end of the drum (20), there is provided a groove (20*c*), in which a rib (20*d*) is formed for guiding lateral movement and for restraining rotation of a minute detecting plate (25) relative to the drum (20) as shown in FIG. 1.

A cam (25*a*) which drops into a hole (10*b*) provided on a second minute wheel (10) is provided on the minute detecting plate (25). On the left end of the drum (20), there is provided an alarm time setting knob (15), by which alarm time is set. A pinion (20*b*) provided on the right end of the minute unit alarm time indicating drum (20) is engaged with an intermediate wheel (22) which is rotatably fitted on a shaft (19*e*) projecting from the middle plate (19). A pinion (22*a*) combined with the intermediate wheel (22) is engaged with the hour detecting wheel (26) which is slidable on the shaft (7) in the axial direction.

A cam (26*a*) which drops into the hole (8*b*) of the hour drum is provided on the hour detecting wheel (26).

Figure 3:
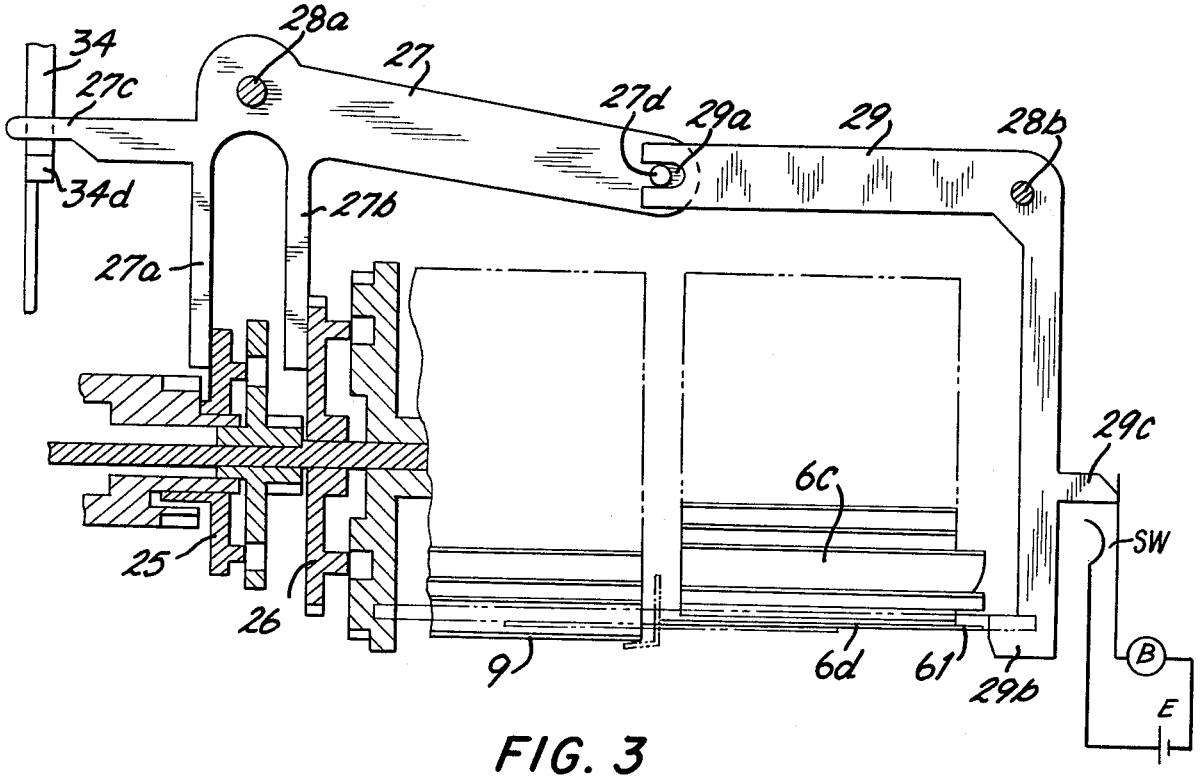
FIG. 3 is a sectional view of the alarm detecting mechanism.
Figure 4:
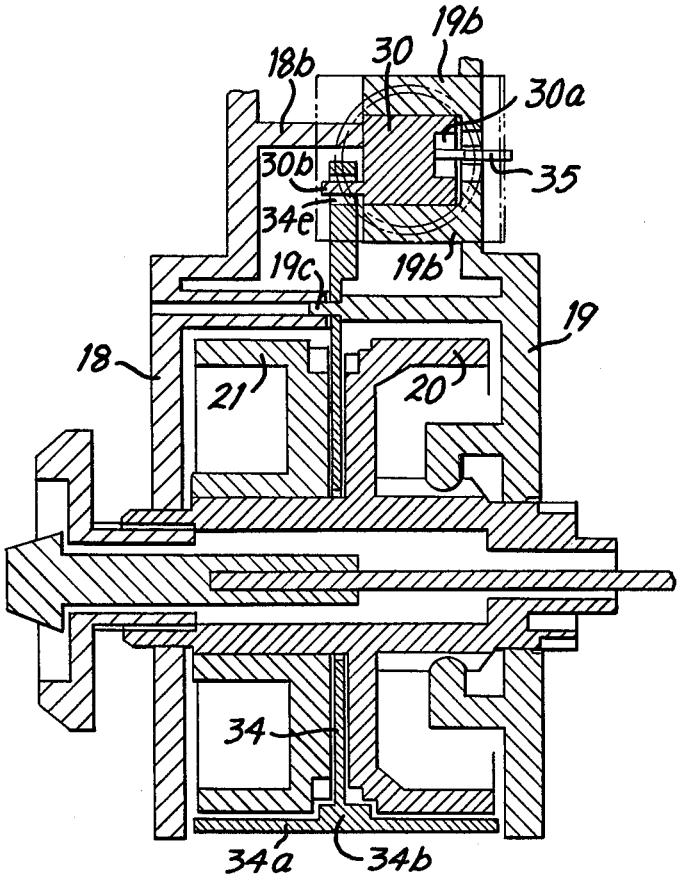
FIG. 4 is a sectional view of the alarm setting mechanism.

Referring now to FIG. 3 illustrating the alarm time detecting mechanism, a first detecting lever (27) is rotatable on a shaft (28*a*). The first detecting lever (27) has a first arm (27*a*) and a second arm (27*b*) for operating the minute detecting wheel (25) and the hour detecting wheel (26), respectively, a third arm (27*c*) related with an operating arm (34*d*) of the alarm setting indicating plate and a pin (27*d*). A second detecting lever (29), having a fork end (29*a*) engaging with the pin (27*d*) on the first detecting lever, a projection (29*b*) related with the right projections (61) of the third leaves (6*c*) and the fourth leaves (6*d*) on the other end, and a second projection (29*c*) for operating a switch (SW), is rotatable on a shaft (28*b*). The switch (SW) and a buzzer (B) are connected in series to a power source (E).

The manner of operation of the various components described in connection with the drawings will be explained hereinafter.

In using the alarm device, as the alarm stopping button (32) is pushed to reset to the upper position, the alarm (as viewed in FIG. 6) setting indicating plate (34) is turned counterclockwise interlocking with the resetting motion so that the first shutter (34*a*) is retracted from the alarm time indicating window (40*a*) and the alarm time marks on the drums (20) and (21) are seen in the window (40*a*). At the same time, the restraint on the first detecting lever (27) by the operating arm (34*d*) of the alarm setting indicating plate (34) is released. A desired alarm time is set on the minute unit indicating drum (20) and the hour unit indicating drum (21) by turning the alarm time setting knob (15). According to the alarm time setting operation, the phase of the cams (25*a*) and (26*a*) of the minute detecting wheel (25) and the hour detecting wheel (26), respectively, is determined. After the clock has been thus adjusted, the motor (1) drives the minute wheel (2), the minute drum (3), the second minute wheel (10) and the hour drum (8) through the intermediate hour wheel.

As time advances, first the hole (8*b*) on the hour drum and the cam (26*a*) on the hour detecting wheel (26) coincide in phase allowing the hour detecting wheel (26) to be shifted rightwards by the force of the switch (SW) through the detecting lever (27), however, the hour detecting wheel (26) will not be shifted rightwards until the cam (25*a*) on the minute detecting wheel (25) and the hole (10*b*) on the second minute wheel coincide in phase simultaneously allowing the first and second detecting levers (27) and (29) to turn and the switch (SW) to close. As time advances further, the cam (25*a*) on the minute detecting wheel (25) and the hole (10*b*) on the second minute wheel (10) coincide in phase with the hole (8*b*) and the cam (26*a*) in agreement in phase, then the minute detecting wheel (25) and the hour detecting wheel (26) are allowed to be shifted rightwards according to the turning of the first detecting lever (27) by the force of the switch (SW). However, the first detecting lever (27) will not be allowed to turn as the projection (29*b*) of the second detecting lever (29) is restrained by the right projection (61) of the third leaves (6*c*) or the fourth leaves (6*d*) so that the switch (SW) is not closed yet. When the second detecting lever (29) is released from the restraint by the right projection (61) of the third leaves (6*c*) or the fourth leaves (6*d*), for instance, when time advances from 59 minute to 00 minute, the second detecting lever (29) is allowed to turn so that the switch (SW) is closed to actuate the buzzer (B).

When the alarm stopping button (32) is depressed while the buzzer (B) is working, the alarm stopping button is locked at the lower position as shown in FIG. 6, the operating arm (34*d*) pushes the first detecting lever (27) to turn the second detecting lever (29) counterclockwise about the shaft (28*b*) opening the switch (SW) with the second projection (29*c*) so that the buzzer (B) stops working.

At the same time, the first shutter (34*a*) of the alarm setting indicating plate covers the alarm time indicating window (40*a*) hiding the alarm time marks.

The aforesaid objects of the invention are attained by the alarm device according to the present invention. Additionally, a clock having the alarm device of this invention is provided with a good appearance as the advancing teeth, provided for the hour unit alarm time indicating drum and the minute unit alarm time indicating drum provided for indicating the alarm time more clearly, are covered by the second shutter and also the alarm time will be better recognized by the provision of dots on the second shutter.

What we claim is:

1. An alarm setting indication device for a digital clock having an alarm device, a first drum having thereon figures for indicating the hour unit of alarm time, and a second drum having thereon figures for indicating the minute unit of alarm time, said indication device comprising: a setting indication plate provided with a shutter; means for setting and stopping operation of said alarm device; and indication plate positioning means, cooperative with said means for setting and stopping operation of said alarm device, for positioning said plate shutter to cover the figures on said first and second drums when operation of said alarm device is stopped and for positioning said plate shutter to uncover the figures on said first and second drums when said alarm device is set for operation.

2. An alarm setting indication device as set forth in claim 1, wherein said setting indication plate is provided with a second shutter, said second shutter being configured to cover up a gap between said first and second drums.

3. An alarm setting indication device as set forth in claim 2, wherein said setting indication plate is marked with at least one dot to separate the hour unit of alarm time from the minute unit of alarm time.

4. An alarm setting indication device as set forth in claim 1, 2 or 3: wherein said setting indication plate is positioned between said first drum and said second drum, said shutter extends outwardly from said setting indication plate opposite said first and said second drums; and said positioning means for positioning said plate shutter comprises means mounting said setting indication plate for pivoting between a position with said plate shutter covering the figures on said first and second drums indicating the alarm time and a position leaving the figures on said first and second drums indicating the alarm time uncovered.

5. An alarm setting indication device as set forth in claim 4, wherein said setting indication plate includes an arm extending outwardly from said setting indication plate and movable for pivoting said setting indication plate; and said means for setting and stopping operation of said alarm device includes a manually operable switch mechanism comprising means cooperative with said setting indication plate arm for pivoting said setting indication plate to position said shutter to cover from view the drum figures indicating the alarm time when said alarm device is stopped from operating and for pivoting said setting indication plate to position said shutter to expose for viewing the drum figures indicating the alarm time when said alarm device is set for operation.

6. In a digital alarm clock having a first drum positionable for setting the hour unit of an alarm time and having figures thereon for indicating the hour unit of the alarm time, a second drum positionable for setting the minutes unit of the alarm time and having figures thereon for indicating the minutes unit of the alarm time, and an alarm mechanism cooperative with said first and second drums for emitting an alarm signal at the alarm time determined by the setting of said first and second drums, the improvement comprising: an indication plate having a shutter extending therefrom; mounting means for mounting said indication plate to permit positioning of said indication plate shutter at a first position covering the figures on said first and said second drums indicating the alarm time and to permit positioning of said indication plate shutter at a second position uncovering the figures on said first and said second drums indicating the alarm time; and said indication plate including means cooperative with said alarm mechanism for disenabling said alarm mechanism when said indication plate is positioned with said indication plate shutter covering the figures on said first and second drums indicating the alarm time.

7. In a digital alarm clock as set forth in claim 6, said alarm mechanism comprising a detecting lever for changing position to operate said alarm mechanism when the time kept by the alarm clock is the same as the alarm time set by said first and said second drums, and said means for disenabling said alarm mechanism is comprised on an arm extending from said indication plate and positioned for preventing said detecting lever from changing position when said indication plate is positioned so that said indication plate shutter covers the alarm time indicated by the figures on said first and said second drums.

8. In a digital alarm clock as set forth in claim 6 or 7, means for setting and stopping operation of said alarm mechanism; and indication plate positioning means, cooperative with said means for setting and stopping operation of said alarm mechanism, for positioning said plate shutter to cover the figures on said first and second drums when operation of said alarm mechanism is stopped and for positioning said plate shutter to uncover the figures on said first and said second drums when said alarm mechanism is set for operation.

9. In a digital alarm clock as set forth in claim 8, wherein said indication plate includes a second shutter configured to cover a gap between said first and said second drums.

10. In a digital alarm clock as set forth in claim 8, wherein said indication plate is marked with at least one dot to separate the hour unit of alarm time from the minute unit of alarm time.

* * * * *